US008879772B2

(12) United States Patent
Miyajima

(10) Patent No.: US 8,879,772 B2
(45) Date of Patent: Nov. 4, 2014

(54) SPEAKER DEVICE

(71) Applicant: Funai Electric Co., Ltd., Osaka (JP)

(72) Inventor: Kazutoshi Miyajima, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 13/858,214

(22) Filed: Apr. 8, 2013

(65) Prior Publication Data

US 2013/0322678 A1 Dec. 5, 2013

(30) Foreign Application Priority Data

May 31, 2012 (JP) ..... 2012-123994

(51) Int. Cl.
*H04R 25/00* (2006.01)

(52) U.S. Cl.
USPC ..... 381/388; 381/333; 381/386

(58) Field of Classification Search
USPC ..... 381/332–336, 386–389, 392, 395, 189
See application file for complete search history.

(56) References Cited

U.S. PATENT DOCUMENTS

| | | | | |
|---|---|---|---|---|
| 6,876,752 | B1 * | 4/2005 | Guenther | 381/386 |
| 7,570,778 | B2 * | 8/2009 | Wright | 381/387 |
| 2007/0064964 | A1 | 3/2007 | Cheung | |
| 2009/0046876 | A1 | 2/2009 | Reck | |

FOREIGN PATENT DOCUMENTS

| | | | |
|---|---|---|---|
| GB | 496504 | A | 12/1938 |
| JP | 08-84395 | A | 3/1996 |
| JP | 2007-124294 | A | 5/2007 |

OTHER PUBLICATIONS

Extended European Search Report dated Jun. 24, 2013 for corresponding EP application No. 13162880.2.

* cited by examiner

*Primary Examiner* — Suhan Ni
(74) *Attorney, Agent, or Firm* — Morgan, Lewis & Bockius LLP

(57) ABSTRACT

A speaker includes a diaphragm, a housing, and a sound blocking member. The housing fixes an edge of the diaphragm. The sound blocking member is disposed on a surface of the housing different from an audio output surface thereof and in the vicinity of the diaphragm.

20 Claims, 6 Drawing Sheets

SPEAKER DEVICE

This application is based on Japanese Patent Application No. 2012-123994 filed on May 31, 2012, the contents of which are hereby incorporated by reference.

BACKGROUND OF THE INVENTION

1. Field of the Invention

The present invention relates to a speaker device and an apparatus associated therewith.

2. Description of Related Art

Recent years have seen the widespread use of a flat-screen television receiver using a LCD (a liquid crystal display) or a PDP (a plasma display panel). A commonly used type of flat-screen television receiver has a front cabinet, a rear cabinet, and a speaker. The front cabinet includes a rectangular front portion and a side wall portion that is provided so as to stand rearward from each of four sides of the front portion. The rear cabinet covers a rear surface side of the front cabinet. The speaker is mounted to the front cabinet and outputs sound.

In the flat-screen television receiver described above, in order to achieve a simple appearance thereof from its front, a hole for passing sound from the speaker therethrough is often formed at a location (such as the side wall portion) in the front cabinet, which is not viewable from the front. The speaker is disposed such that a sound output opening thereof, from which a diaphragm is exposed, is opposed to the hole formed at the side wall portion of the front cabinet. In this case, a gasket is interposed and fixed between a flange portion of the speaker and the side wall portion.

Furthermore, JP-A-2007-124294 discloses a speaker device that, instead of using a gasket, houses a speaker in a holder.

One reason why, as described above, a periphery of a front surface of the diaphragm of the speaker is covered with a sound blocking member such as a gasket is to prevent audio in positive phase outputted from a front surface of the speaker and audio in negative phase outputted from a rear surface of the speaker from cancelling out each other. By the basket and the cabinet, audio in negative phase is blocked from travelling toward the front surface of the speaker.

In a case of using a gasket made of cardboard or foam resin, however, at the time of assembly, the gasket is slid in a state of being pressed against the front cabinet, which causes interlayer delamination of the cardboard or collapse of the foam resin. Such situations result in generation of abnormal sound. Furthermore, typically, a gasket is manufactured by stamping, and thus manufacturing thereof requires great care and is wasteful in a sense that residual material left after stamping is discarded. A holder, on the other hand, needs to be molded of an elastic body such as rubber and thus is costly.

SUMMARY OF THE INVENTION

The present invention has been made in view of the above-described problems, and it is an object of the present invention to provide a speaker including a sound blocking member that is easily manufactured without causing waste. Furthermore, it is also an object of the present invention to provide a speaker device including the speaker.

In order to achieve the above-described objects, a speaker of the present invention includes a diaphragm, a housing that fixes an edge of the diaphragm, and a sound blocking member that is disposed on a surface of the housing different from an audio output surface thereof and in the vicinity of the diaphragm.

According to this configuration, in place of a conventional sound blocking member formed by stamping, a sound blocking member that is easily manufactured without causing waste can be used.

In the above-described speaker, preferably, from the viewpoint of obtaining an effect of the sound blocking member to a maximal extent, the sound blocking member is provided along, for example, an entire periphery of an outer peripheral surface of the housing.

Furthermore, in the above-described speaker, in order to enable easy assembly, the sound blocking member may be, for example, a linear member and wound around the housing.

Furthermore, in the above-described speaker, the housing may have a horizontally elongated shape.

Furthermore, in the above-described speaker, the sound blocking member may be wound from, as a winding starting point, a point on the housing in a shorter length direction thereof.

Furthermore, in the above-described speaker, preferably, in order to obtain an effect as a gasket, the sound blocking member includes a foam member or an elastic member.

Furthermore, in the above-described speaker, from the viewpoint of imparting freedom in configuration with consideration given to assembling processes and so on, there can be adopted a configuration in which a front surface of the sound blocking member and a front surface of the housing are flush with each other or a configuration in which the front surface of the sound blocking member protrudes forward with respect to a front surface of the diaphragm.

Furthermore, from the viewpoint of being applicable to various types of products, the present invention may provide a speaker device including the above-described speaker and a cover that makes contact with an outer periphery of the sound blocking member and covers a rear surface of the speaker.

In the above-described speaker device, a configuration may be adopted in which the cover is composed of a front cover having a first holding portion and a rear cover having a second holding portion, and the first holding portion and the second holding portion make contact with the outer periphery of the sound blocking member and, in that state, hold the speaker by sandwiching the speaker therebetween.

Furthermore, in the above-described speaker device, a configuration may be adopted in which the speaker includes a mounting portion having a hole, while the cover includes a support portion, and the support portion is inserted into the hole.

Furthermore, from the viewpoint of being applicable to various types of products, the present invention may provide a display apparatus including the above-described speaker device and a display part.

According to the present invention, the sound blocking member is provided on a surface of the housing different from an audio output surface thereof and in the vicinity of the diaphragm, and thus in place of a conventional sound blocking member formed by stamping, a sound blocking member that is easily manufactured without causing waste can be used.

DETAILED DESCRIPTION OF PREFERRED EMBODIMENTS

Hereinafter, a display apparatus of the present invention will be described by taking a digital television receiver as one example thereof.

Figure 1:
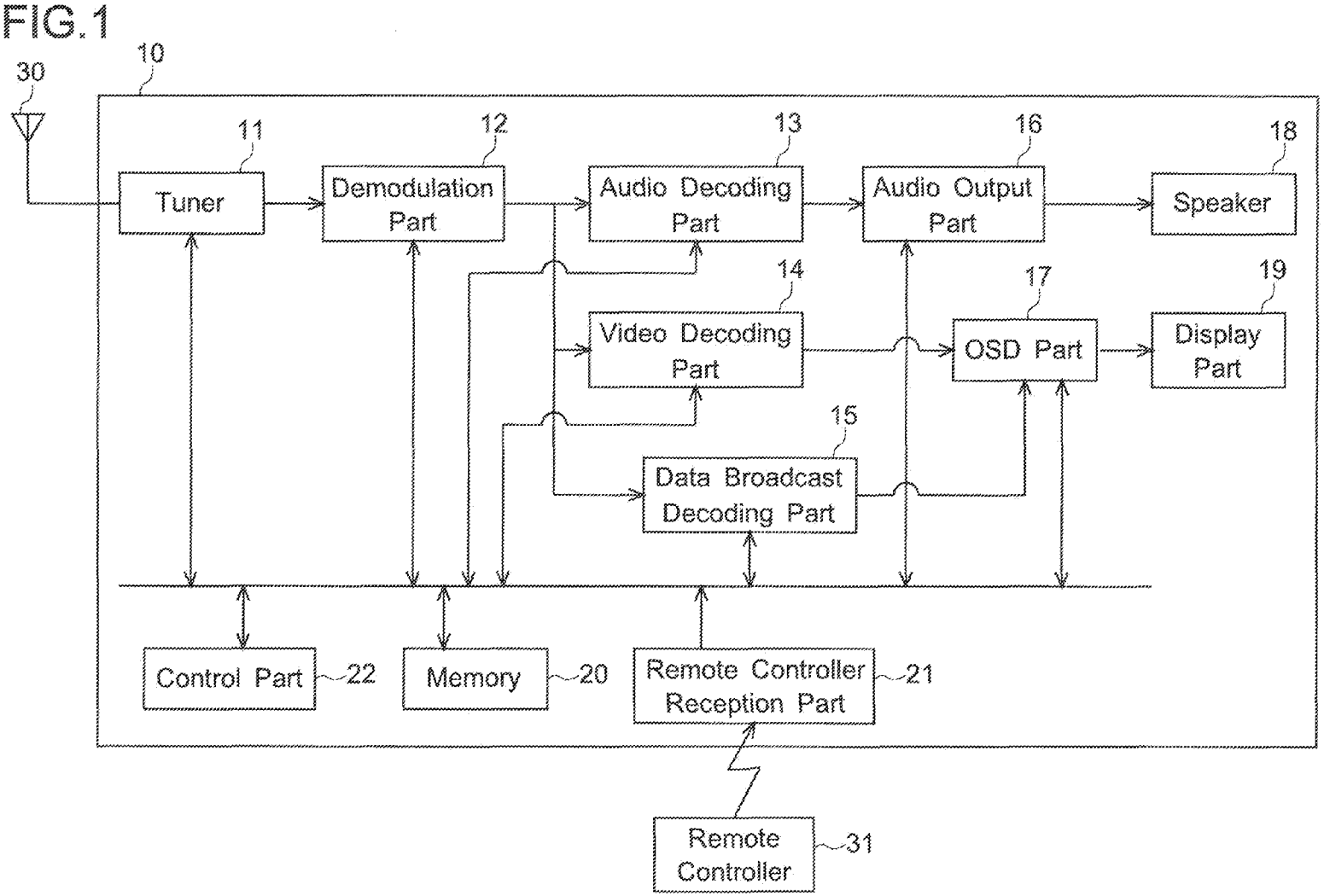
FIG. 1 is a block diagram showing a configuration of a digital television receiver of one embodiment of the present invention and peripheral equipment thereof.

FIG. 1 is a block diagram showing a configuration of a digital television receiver of one embodiment of the present invention and peripheral equipment thereof. An antenna 30 is connected to a digital television receiver 10. Furthermore, the digital television receiver 10 is operable via a remote controller 31.

The digital television receiver 10 includes a tuner 11, a demodulation part 12, an audio decoding part 13, a video decoding part 14, a data broadcast decoding part 15, an audio output part 16, an OSD (on-screen display) part 17, a speaker 18, a display part 19, a memory (storage part) 20, a remote controller reception part 21, and a control part 22.

The tuner 11 generates, based on a radio wave received with the antenna 30, a digital television broadcast signal having a predetermined frequency and converts it into a digital signal. The demodulation part 12 subjects a digital signal received from the tuner 11 to demodulation processing to generate an MPEG transport stream (TS), divides it according to purposes into an audio packet, a video packet, a data broadcast packet, a management information packet, and so on, and outputs the packets.

The audio decoding part 13 decodes an audio packet received from the demodulation part 12 to generate an audio signal and outputs the audio signal to the audio output part 16. The audio output part 16 converts an audio signal received from the audio decoding part 13 into an analog signal and outputs the analog signal to the speaker 18. The video decoding part 14 decodes a video packet received from the demodulation part 12 to generate a video signal and outputs the video signal to the OSD part 17. The data broadcast decoding part 15 decodes a data broadcast packet received from the demodulation part 12 to generate a data broadcast signal and outputs the data broadcast signal to the OSD part 17.

The OSD part 17 combines a video signal received from the video decoding part 14 with a data broadcast signal received from the data broadcast decoding part 15 in accordance with an instruction of the control part 22 to generate image data to be displayed on the display part 19. The display part 19 is constituted by a liquid crystal display apparatus, an organic EL display apparatus, or the like and displays a screen corresponding to image data received from the OSD part 17.

The memory 20 is constituted by a ROM, a RAM, or the like. The remote controller reception part 21 receives a signal from the remote controller 31 and outputs the signal to the control part 22. The control part 22 performs control of the various parts of the digital television receiver 10.

Figure 2:
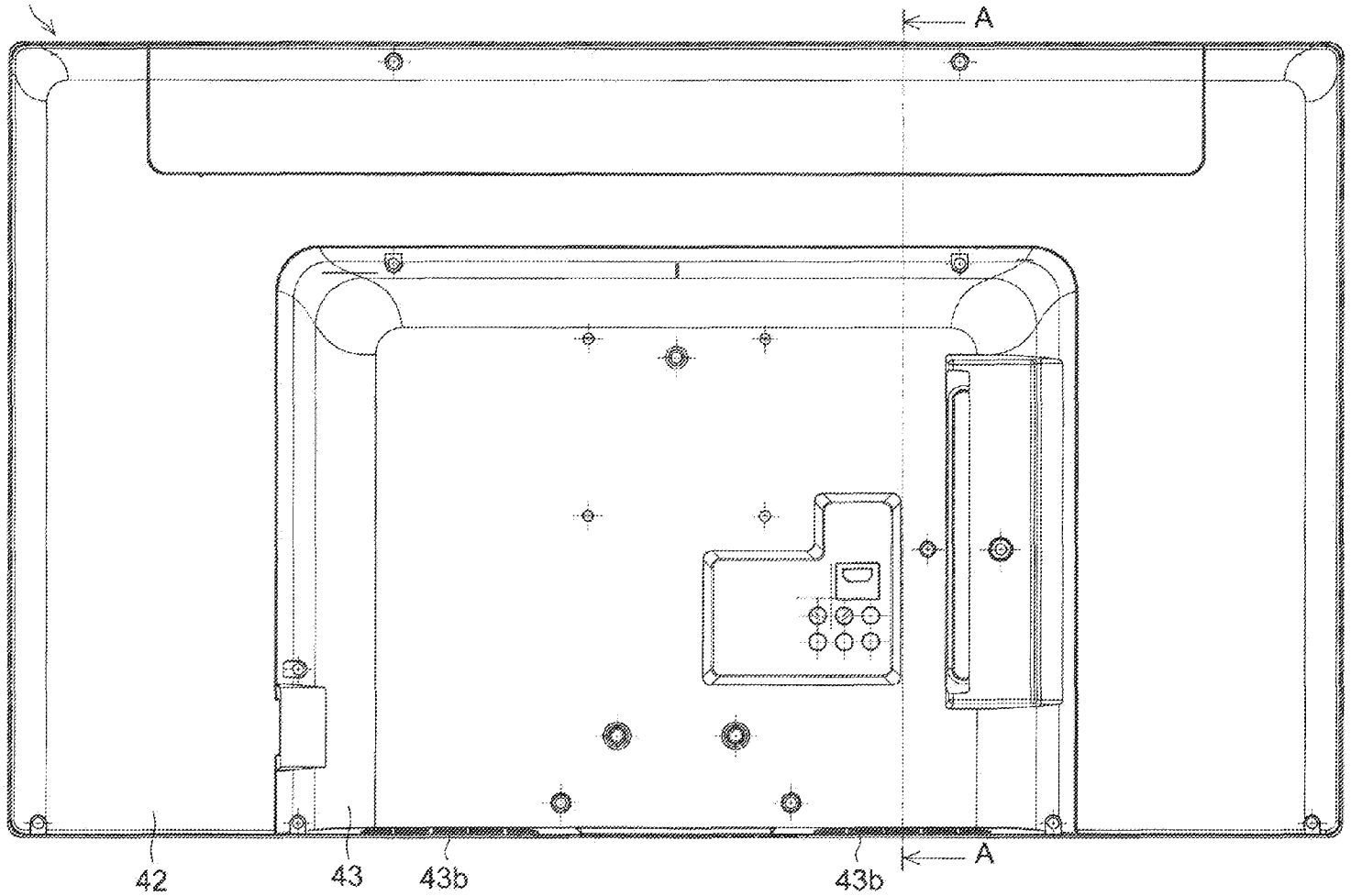
FIG. 2 is a rear view of the digital television receiver of the one embodiment of the present invention.
Figure 3:
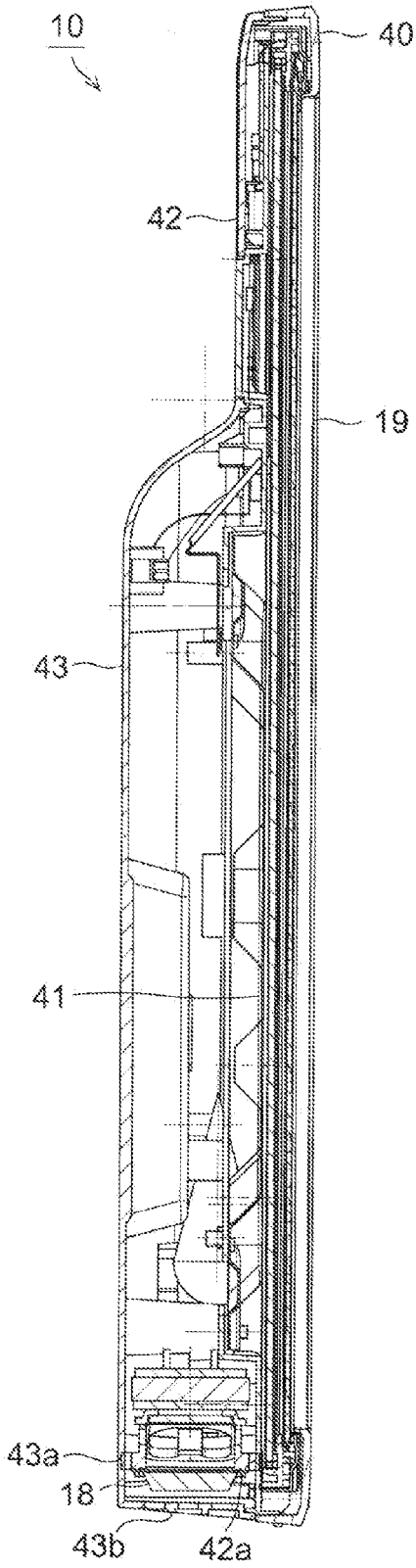
FIG. 3 is a sectional view taken on line A-A of FIG. 2.
Figure 4:
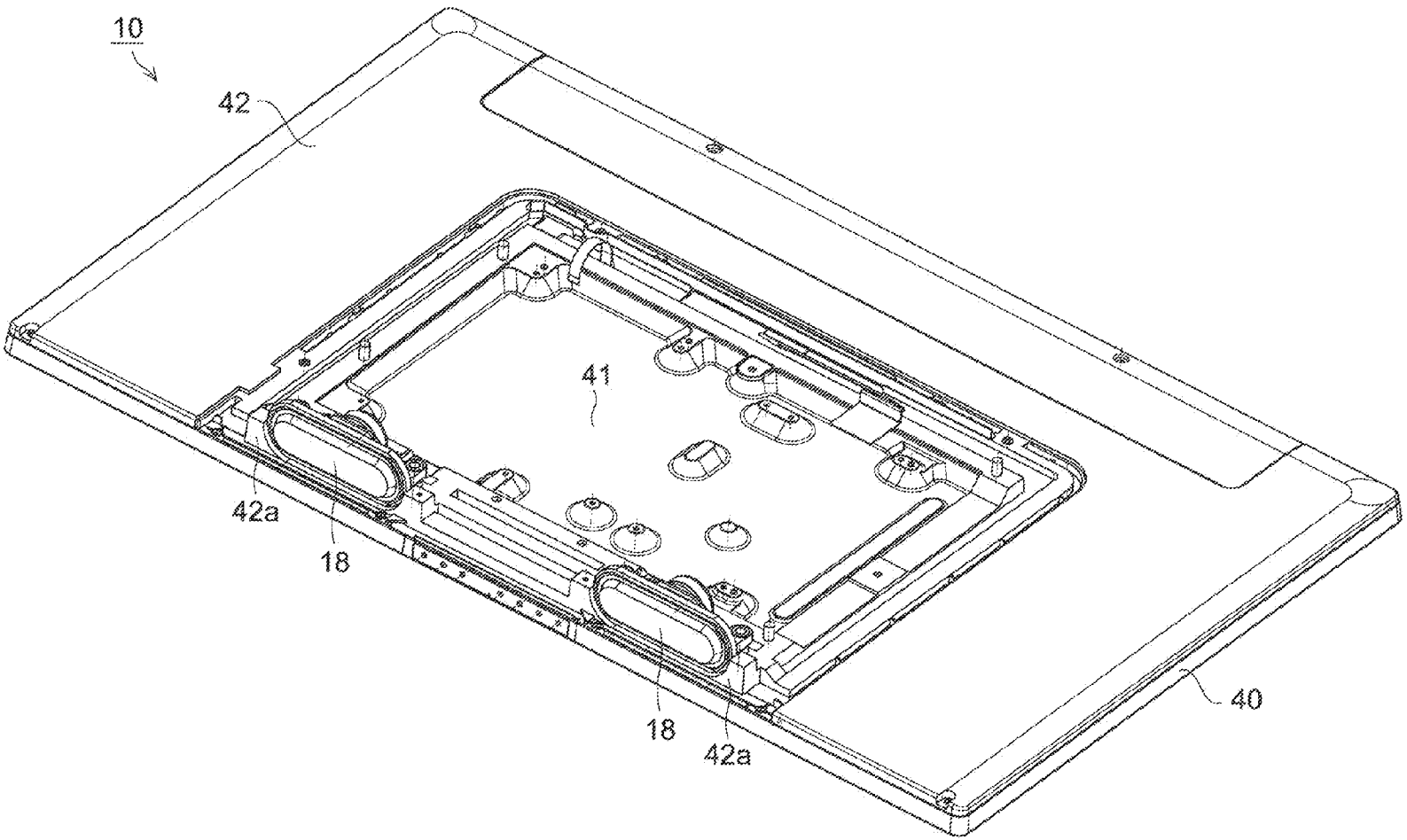
FIG. 4 is a perspective view showing a configuration of a main portion inside the digital television receiver of the one embodiment of the present invention.
Figure 5:
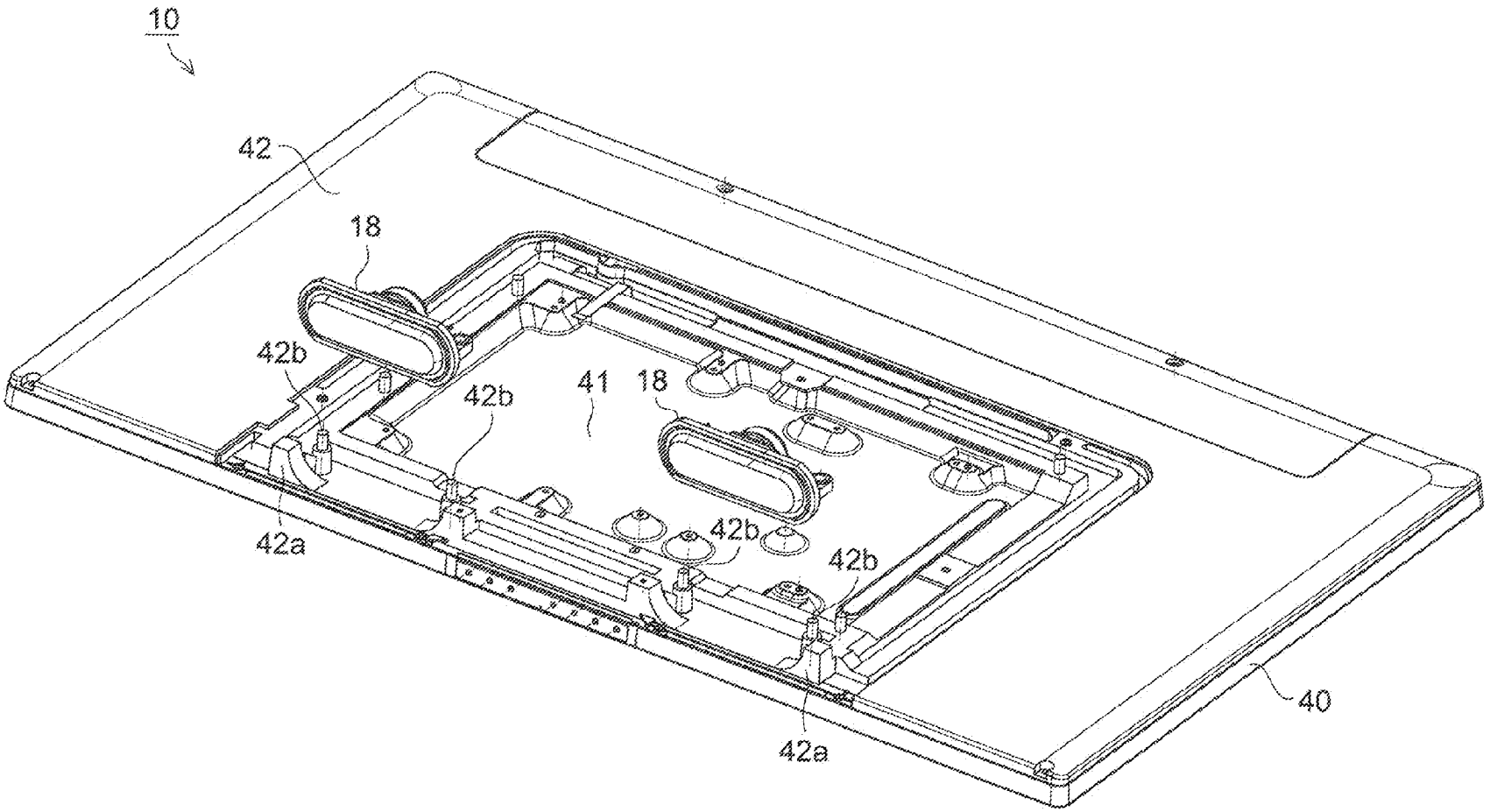
FIG. 5 is an exploded perspective view based on FIG. 4.
Figure 6:
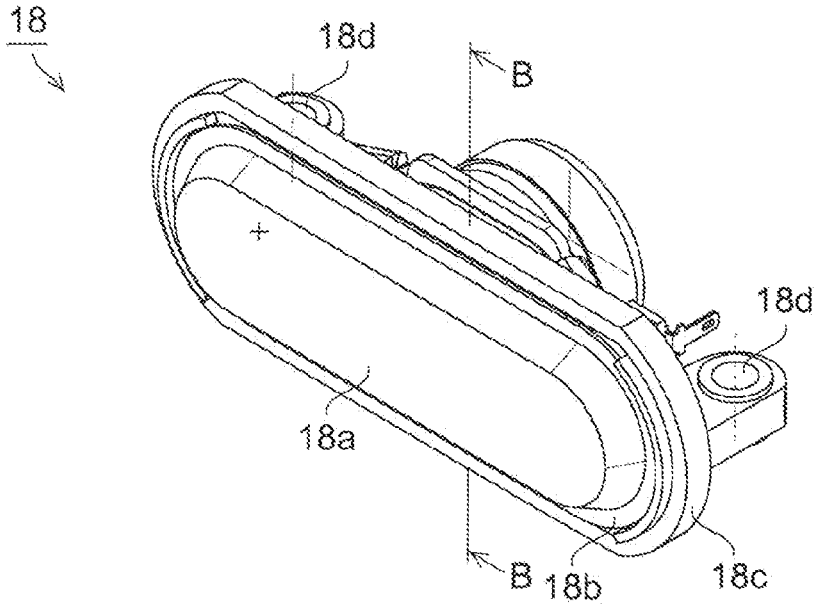
FIG. 6 is a perspective view of a speaker of the digital television receiver of the one embodiment of the present invention.
Figure 7:
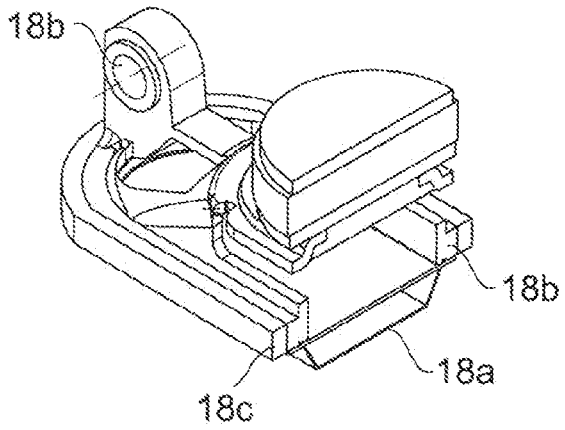
FIG. 7 is a sectional view taken on line B-B of FIG. 6.

FIG. 2 is a rear view of the digital television receiver 10. FIG. 3 is a sectional view taken on line A-A of FIG. 2. FIG. 4 is a perspective view showing a configuration of a main portion inside the digital television receiver 10. FIG. 5 is an exploded perspective view based on FIG. 4. FIG. 6 is a perspective view of a speaker of the digital television receiver 10. FIG. 7 is a sectional view taken on line B-B of FIG. 6.

The digital television receiver 10 includes a bezel 40, a front frame 41, a rear frame 42, a rear cover 43, two speakers 18 (hereinafter, may be referred to collectively as the speaker 18), and the display part 19. The bezel 40, the rear frame 42, and the rear cover 43 constitute a housing that defines an outer appearance of the digital television receiver 10.

The bezel 40 is a rectangular frame-shaped frame body having an opening portion that the display part 19 faces and constitutes a front surface of the digital television receiver 10 by sandwiching the display part 19 between itself and the front frame 41. The bezel 40 can be molded from resin or metal.

The front frame 41 is a rectangular member that houses, on a front surface side thereof, the display part 19, and on a rear surface side thereof, a circuit board on which the tuner 11, the control part 22, and so on are mounted and is surrounded by the bezel 40, the rear frame 42, and the rear cover 43. The front frame 41 can be molded from resin or metal.

The rear frame 42 is a plate-shaped member having an opening portion that the circuit board faces and constitutes a rear surface of the digital television receiver 10 by sandwiching the front frame 41 between itself and the bezel 40. The rear frame 42 can be molded from resin or metal.

Furthermore, the rear frame (front cover) 42 has holding portions (first holding portions) 42*a* (hereinafter, may be referred to collectively as a holding portion 42*a*) that hold the speakers 18, respectively, in a sandwiching manner and four support portions 42*b* (hereinafter, may be referred to collectively as a support portion 42*b*) that hold the speakers 18 in such a manner that the speakers 18 are fitted thereto by insertion. The holding portion 42*a* is formed in the neighborhood of a lower end of the rear frame 42 integrally with the rear frame 42 so as to protrude to a rear surface side thereof. The holding portion 42*a* is shaped for contact (press-contact) with an outer periphery of an after-mentioned gasket of the speaker 18 and, in this embodiment, has a semielliptical shape. A groove for the gasket to fit in may be provided in the holding portion 42*a*.

The support portion 42*b* is a rod-shaped portion that is formed integrally with the rear frame 42 so as to protrude from the rear surface side thereof. After-mentioned holes of the speaker 18 are each inserted over the support portion 42*b*. The support portion 42*b* is used for positioning of the speaker 18 and supports the speaker 18. The speaker 18 may be supported by using a structure other than the support portion 42*b*.

The rear cover 43 is a member that is fitted in a U-shaped cutout portion of the rear frame 42 so as to cover the circuit board and, together with the rear frame 42, constitutes the rear surface of the digital television receiver 10. The rear cover 43 can be molded from resin or metal.

Furthermore, the rear cover 43 has semielliptical holding portions (second holding portions) 43*a* (hereinafter, may be referred to collectively as a holding portion 43*a*) that hold the speakers 18, respectively, in a sandwiching manner and lattice portions 43*b* (hereinafter, may be referred to collectively as a lattice portion 43*b*) that are opposed to the speakers 18, respectively. The holding portion 43*a* is formed in the neighborhood of a lower end of the rear cover 43 integrally with the rear cover 43 so as to protrude forward. The holding portion 43*a* is shaped for contact (press-contact) with the outer periphery of the after-mentioned gasket of the speaker 18 and, in this embodiment, has a shape substantially symmetrical to the holding portion 42*a* of the rear frame 42, which is a semielliptical shape. A groove for the gasket to fit in may be provided in the holding portion 43*a*.

The lattice portion 43*b* is a portion that is formed so as to be opposed to a diaphragm of the speaker 18 and is pierced in a lattice manner. The lattice portion 43*b* outputs sound of the speaker 18 to the outside of the digital television receiver 10 and protects the speaker 18 from any external object. Separately from the rear cover 43, there may be provided a portion to which a stand for holding the digital television receiver 10 is mounted and a stand holder having a lattice portion similar to the above.

The speaker 18 has a diaphragm 18*a* for outputting sound, a housing 18*b* that fixes an edge of the diaphragm 18*a*, a gasket (sound blocking member) 18*c* that is disposed on a surface (in this embodiment, an outer peripheral surface) of the housing 18*b* different from an audio output surface thereof and in the vicinity of the diaphragm 18*a*, and a mounting portion that has two holes 18*d* for mounting (hereinafter, may be referred to collectively as a hole 18*d*).

The diaphragm 18*a* is bonded to an edge portion of the housing 18*b* so as to cover an opening portion of the housing 18*b*. In this embodiment, the housing 18*b* has a horizontally elongated shape. The housing 18*b* is a member that is integrally molded from, for example, resin and has the edge portion defining the opening portion having a substantially elliptical shape. The housing 18*b* may partly or entirely cover a rear surface of the diaphragm 18*a*. The mounting portion having the hole 18*d* is formed integrally with the housing 18*b*, and the hole 18*d* is fitted by insertion over the support portion 42*b* of the rear frame 42.

The gasket 18*c* is provided along an entire periphery of an outer peripheral surface of the edge portion of the housing 18*b*. The gasket 18*c* may be provided, instead of completely along the entire periphery of the outer peripheral surface, along a substantially entire periphery thereof, having a portion where a gap or a seam is formed. Furthermore, the gasket 18*c* may be provided in layers so that a gap or a seam therein is compensated for. The gasket 18*c* is held in a sandwiched manner by the holding portion 42*a* of the rear frame 42 and the holding portion 43*a* of the rear cover 43. By the gasket 18*c*, audio outputted from a rear surface of the speaker 18 is blocked from travelling toward a front surface of the speaker 18. Thus, it is possible to prevent audio in positive phase outputted from the front surface of the speaker 18 and audio in negative phase outputted from the rear surface of the speaker 18 from cancelling out each other.

The gasket 18*c* is constituted by, for example, a foam member such as of polyurethane or an elastic member such as of rubber, and as the gasket 18*c*, there can be used a linear (tape-shaped) material rectangular in section, with an adhesive applied to one surface thereof. The gasket 18*c* may be constituted by a combination of a plurality of materials. At the time of assembly, the gasket 18*c* is wound around and bonded to the outer peripheral surface of the housing 18*b*. In a case where the gasket 18*c* is constituted by a linear material as described above, the gasket 18*c* can be wound from, for example, as a winding starting point, a point on the housing 18*b* in a shorter length direction thereof. Using a linear material as the gasket 18*c* as described above eliminates the need to manufacture the gasket 18*c* by stamping as in the conventional technique. This can reduce waste to be discarded and also facilitates processing of the gasket 18*c*.

Furthermore, since the gasket 18*c* is provided on the outer peripheral surface of the housing 18*b*, it is also possible to design the gasket 18*c* to have an increased width. With the gasket 18*c* increased in width, bonding the gasket 18*c* provides an increased fixing force, and thus it is possible to prevent defectiveness due to delamination or collapse of the gasket 18*c* at the time of assembly. For example, a configuration may be adopted in which a groove is provided on the outer peripheral surface of the housing 18*b*, and the gasket 18*c* is fitted therein so as to be fixed without the use of an adhesive. Furthermore, a configuration also may be adopted in which the gasket 18*c* is provided with an appropriate number of convex portions, while the housing 18*b* is provided on the outer peripheral surface thereof with concave portions in which the convex portions are to be fitted, respectively, and the convex portions are fitted in the concave portions, respectively, so that the gasket 18*c* is fixed without the use of an adhesive.

As shown in FIGS. 6 and 7, in this embodiment, a front surface of the gasket 18*c* and a front surface of the housing 18*b* are flush with each other, the front surface of the gasket 18*c*, however, may protrude forward (downward of the digital television receiver 10) with respect to a front surface of the diaphragm 18*a*. In this case, sound blocking can be achieved also by a configuration in which the front surface of the gasket 18*c* and a side surface (upper side surface) of each of the holding portions 42*a* and 43*a* are in contact (press-contact) with each other.

Furthermore, one embodiment of the present invention may be a speaker device including the above-described speaker 18 and at least one cover that makes contact with the outer periphery of the gasket 18*c* and covers the rear surface of the speaker 18. As the cover, typically used are a plurality of members such as the front frame 41 and the rear frame 42 described above. Possible examples of such a speaker device include a speaker box that is a standalone device constituted by a speaker.

Furthermore, one embodiment of the present invention may be a display apparatus including the above-described speaker device and a display part. Possible examples of such a display apparatus include, in addition to the above-described digital television receiver 10, various types of displays such as of a personal computer.

While in the above-described embodiment, the housing 18*b* of the speaker 18 has a substantially elliptical front shape, the front shape is not limited thereto and may be, for example, a rectangular shape, any of other polygonal shapes, a circular shape, or the like.

The foregoing embodiments can be implemented in combination whenever possible.

What is claimed is:

1. A speaker, comprising:

a diaphragm;

a housing that fixes an edge of the diaphragm; and a sound blocking member that is disposed on a surface of the housing different from an audio output surface thereof and in a vicinity of the diaphragm, wherein the sound blocking member is a linear member, the sound blocking member is wound around the housing, and the sound blocking member is wound from, as a winding starting point, a point on the housing in a shorter length direction thereof.

2. The speaker according to claim 1, wherein the sound blocking member is provided along an entire periphery of an outer peripheral surface of the housing.

3. The speaker according to claim 1, wherein the housing has a horizontally elongated shape.

4. The speaker according to claim 1, wherein
the sound blocking member comprises a foam member or an elastic member.

5. The speaker according to claim 1, wherein
a front surface of the sound blocking member and a front surface of the housing are flush with each other.

6. The speaker according to claim 1, wherein
a front surface of the sound blocking member protrudes forward with respect to a front surface of the diaphragm.

7. A speaker device, comprising:
the speaker according to claim 1; and
a cover that makes contact with an outer periphery of the sound blocking member and covers a rear surface of the speaker.

8. The speaker device according to claim 7, wherein
the speaker comprises a mounting portion having a hole, while the cover comprises a support portion, and
the support portion is inserted into the hole.

9. A display apparatus, comprising:
the speaker device according to claim 7; and
a display part.

10. A speaker, comprising:
a diaphragm;
a housing that fixes an edge of the diaphragm; and
a sound blocking member that is disposed on a surface of the housing different from an audio output surface thereof and in a vicinity of the diaphragm,
wherein
the housing has a horizontally elongated shape, and
the sound blocking member is wound from, as a winding starting point, a point on the housing in a shorter length direction thereof.

11. The speaker according to claim 10, wherein
the sound blocking member is provided along an entire periphery of an outer peripheral surface of the housing.

12. The speaker according to claim 10, wherein
the sound blocking member comprises a foam member or an elastic member.

13. The speaker according to claim 10, wherein
a front surface of the sound blocking member and a front surface of the housing are flush with each other.

14. The speaker according to claim 10, wherein
a front surface of the sound blocking member protrudes forward with respect to a front surface of the diaphragm.

15. A speaker device, comprising:
the speaker according to claim 10; and
a cover that makes contact with an outer periphery of the sound blocking member and covers a rear surface of the speaker.

16. The speaker device according to claim 15, wherein
the speaker comprises a mounting portion having a hole, while the cover comprises a support portion, and
the support portion is inserted into the hole.

17. A display apparatus, comprising:
the speaker device according to claim 15; and
a display part.

18. A speaker device, comprising:
a speaker, including:
a diaphragm;
a housing that fixes an edge of the diaphragm; and
a sound blocking member that is disposed on a surface of the housing different from an audio output surface thereof and in a vicinity of the diaphragm; and
a cover that makes contact with an outer periphery of the sound blocking member and covers a rear surface of the speaker,
wherein
the cover is composed of a front cover having a first holding portion and a rear cover having a second holding portion, and
the first holding portion and the second holding portion make contact with the outer periphery of the sound blocking member and, in that state, hold the speaker by sandwiching the speaker therebetween.

19. The speaker device according to claim 18, wherein
the speaker comprises a mounting portion having a hole, while the cover comprises a support portion, and
the support portion is inserted into the hole.

20. A display apparatus, comprising:
the speaker device according to claim 18; and
a display part.

* * * * *